United States Patent [19]

Phillips et al.

[11] Patent Number: 4,621,478

[45] Date of Patent: Nov. 11, 1986

[54] EXTRUDED PLASTIC FLUSH STOP WINDOW MULLION AND FRAMING SYSTEM

[75] Inventors: H. V. Phillips, Brighton; Michael A. Walton, Dexter, both of Mich.

[73] Assignee: NRG Industries, Inc., Ann Arbor, Mich.

[21] Appl. No.: 580,068

[22] Filed: Feb. 14, 1984

[51] Int. Cl.[4] ..... E04C 2/34

[52] U.S. Cl. ..... 52/775; 52/235; 52/399

[58] Field of Search ..... 52/173, 235, 220, 397, 52/775, 398, 399, 788, 776, 171; 339/20, 21, 272; 340/545

[56] References Cited

U.S. PATENT DOCUMENTS

| | | | |
|---|---|---|---|
| 2,101,040 | 12/1937 | Bayley et al. | 109/38 |
| 2,192,899 | 3/1940 | Edmondson | 339/21 R |
| 3,334,463 | 8/1967 | Muessel | 52/775 |
| 3,961,452 | 6/1976 | Hubbard et al. | 52/775 X |

FOREIGN PATENT DOCUMENTS

| | | | |
|---|---|---|---|
| 880066 | 9/1971 | Canada | 52/235 |
| 53862 | 6/1982 | European Pat. Off. | 52/788 |

*Primary Examiner*—Carl D. Friedman
*Assistant Examiner*—Naoko N. Slack
*Attorney, Agent, or Firm*—James M. Deimen

[57] ABSTRACT

A simplified plastic window framing system for single or multiple glazing comprising combinations of complementary extrusions wherein the outward appearance of the finished mullions and peripheral framing appears to be that of single extrusions. In outward appearance the glazing is retained within recesses formed in the mullions or frame members and separable retaining members. The combination creates a substantially rectangular external appearance to the individual mullions and framing members.

The framing members are roughly L-shaped and the mullions are roughly T-shaped in cross section. The retaining members are substantially rectangular or trapezoidal in cross section. As finished units however, the mullions and framing members are both substantially rectangular in cross section with only the co-extruded glass seals slightly protruding from the mullions or framing members. All screw splines, notches and protrusions are hidden from view by the attached retaining members or, in the case of peripheral framing members, the structure to which the window is attached. The L-shaped framing members can be easily adapted by the attachment of two extra retaining members to form mullions virtually indistinguishable from the T-shaped mullion members.

Three different glazing thicknesses can be accommodated by a minimum number of four extrusions. Two of the extrusions are L-shaped framing members, the third and fourth extrusions are rectangular and trapezoidal retaining members. Mullions can be formed by adding additional retaining members to the framing members or fifth and sixth T-shaped mullion members corresponding to the two framing members may be included to minimize assembly time.

As an option, an electrically conductive wire can be co-extruded adjacent the screw splines of each plastic extrusion. At the window corners where metal screws are used to join the mullions and framing members together, the metal screws simultaneously perform the function of electrically connecting the wires together to form wire loops about the window panes. The wire loops about the glazing are ideally situated for the attachment of electrical alarm systems or other sensing units. Other possibilities are window defrosting and heating means.

11 Claims, 17 Drawing Figures

EXTRUDED PLASTIC FLUSH STOP WINDOW MULLION AND FRAMING SYSTEM

BACKGROUND OF THE INVENTION

The invention pertains to the field of window framing for commercial, industrial and residential windows, and in particular, to extended frames for single or multiple glazed windows. For many years window frames constructed of extruded aluminum have been widely available for commercial and residential buildings. Such frames are weather resistant for extended periods of time. In particular, they are resistant to moisture, heat and solar ultraviolet degradation. The aluminum framing, however, is highly heat conductive and severely degraded and corroded by salt mist at seashore locations.

With the exception of marine window frames, such as that disclosed in U.S. Pat. No. 3,868,789, window frames constructed of extruded plastics have not become generally available in the marketplace. U.S. Pat. No. 4,110,942 illustrates a polyvinyl chloride extruded window frame mullion with appendages that may be selectively trimmed, depending on the position of the frame member in the window.

Until recently, most plastics suitable for extrusion have been severely degraded by ultraviolet radiation or otherwise structurally inadequate for window frames. Conversely, most plastic materials that have been resistant to ultraviolet degradation have been unsuitable for extrusion or otherwise unsuitable as the structural component of window frames.

U.S. Pat. No. 4,189,520 and U.S. Pat. No. 3,703,063 each disclose composite structural window frame members. The former patent discloses an extruded plastic structure covered with a thin layer of polymethylmethacrylate as a protective coating exposed to the outside ambient conditions and intended to prevent degradation of the underlying structural plastic shape. The latter patent discloses hollow closed metal sections as the structural members with an outer shell of synthetic material formed with one or more projections to accommodate the glazing and the seals adjacent to the glazing. The above composite window framing utilizes complicated cross sectional shapes. Relatively expensive production methods are required to manufacture the composite structure.

In U.S. Pat. No. 3,703,063 a substantially complicated dual frame structure with additional special joining parts is disclosed for between-pane mullions. The profile members disclosed do not serve as both peripheral frame members and mullions in this window framing system because they cannot be assembled with glass retainers to be either symmetric or asymmetric depending on the purpose for which the members are used. The separate means to retain the glazing in position requires two separate extrusions, one of which must be either cemented or otherwise fastened to the frame member permanently before the glazing is placed and the retaining member snapped into place. In U.S. Pat. No. 4,189,520 the T-shaped extrusion that serves as the structural support includes means to retain a separate glazing retention structure comprising four extrusions to each side of the structural shape.

U.S. Pat. No. 3,455,080 discloses a lightweight window frame comprising two snap together extrusions adapted to hold a single pane. Where mullions are located between panes of glass, dual snap together extrusions both of a different profile from that of the peripheral snap together extrusions are disclosed.

U.S. Pat. No. 3,758,997 discloses a metal window framing system with each complete mullion comprising multiple extrusions. Separate dual extrusions including a seating member and a retaining member are required to retain building panels or glazing to each mullion.

SUMMARY OF THE INVENTION

Applicant's window framing system is directed to simplifying the manufacture and assembly of window framing components by reducing the number of window framing component profiles required and thereby reducing the tooling cost for extrusion dies. Simultaneously, the new window framing system provides for three separate glazing thicknesses as disclosed and the potential for many more, each requiring the addition of only one new extrusion die.

Additional versatility can be obtained by forming mullions in one of two ways. Mullions can be formed by adding an extra glass retaining member to a peripheral frame member thus reducing tool cost at the expense of increased assembly cost or the mullions can be formed in a T-shape with less assembly cost at the expense of increased die cost.

A minimum of four profile shapes are required to form all members of the framing system which can accommodate three glazing thicknesses. The glazing system creates the outward appearance of single extrusions for both the peripheral frames and the mullions, the glazing being inserted in recesse in the framing and mullions to give a flush appearance. Only the glass seals co-extruded with the profiles extend slightly from the rectangular outer appearance of the mullions.

The framing members are roughly L-shaped and the mullions are roughly T-shaped in cross section. The retaining members are substantially rectangular or trapezoidal in cross section. All screw splines, notches and protrusions are hidden from view by the attached retaining members or, in the case of peripheral framing members, the structure to which the window is attached.

As an option, an electrically conductive wire can be co-extruded adjacent the screw splines of each plastic extrusion. At the window corners where metal screws are used to join the mullions and framing members together, the metal screws simultaneously perform the function of electrically connecting the wires together to form wire loops about the window panes. The wire loops are ideally situated for the attachment of electrical alarm systems or other sensing units. Other possibilities are window defrosting and heating means.

DESCRIPTION OF THE PREFERRED EMBODIMENTS

Figure 1:
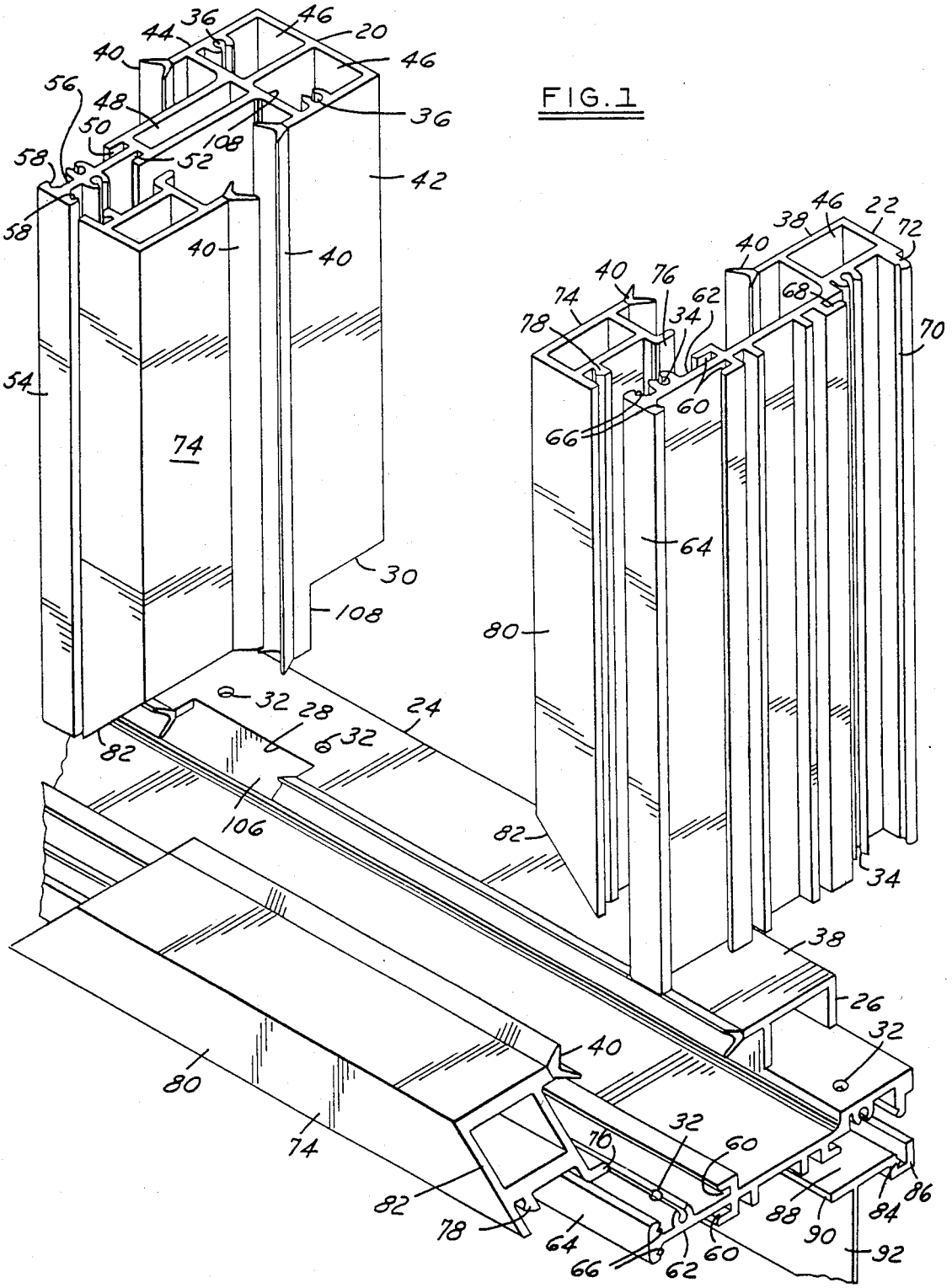
FIG. 1 is an exploded perspective view of the new window framing system.

FIG. 1 illustrates a vertical mullion 20 and vertical peripheral framing member 22 spaced therefrom, both to be attached to a horizontal peripheral framing member 24. In profile the horizontal peripheral member 24 is identical to the vertical peripheral member 22. The horizontal peripheral member 24 is notched at 26 and 28 as shown to accommodate the vertical peripheral member 22 and the mullion 20 respectively. The mullion 20 in turn is notched at 30 to accommodate the horizontal peripheral member. Holes 32 are formed in the horizontal peripheral member 24 for screws to be threaded into the screw splines 34 in the vertical peripheral member and 36 in the mullion.

Each peripheral framing member 22 or 24 includes an integral glass stop or retainer 38 substantially rectangular in cross section and having a glass seal 40 attached thereto.

Although the window framing system disclosed herein can alternatively be constructed of aluminum extrusions, the preferable construction is of extruded plastic materials. With such materials the glass seal 40 can be co-extruded with the peripheral framing member to manufacture a completed integral part in one step.

In a similar manner, the mullion 20 includes a pair of integral glass retainers 42 and 44 on opposite sides of the mullion. The glass seals 40 are preferably co-extruded with the entire mullion 20. If so desired, the mullion 20 and peripheral framing members 22 or 24 can be reinforced by adding a metal rod or tube inserted through the rectangular holes 46. In addition, a rectangular rod can be inserted through the slot 48 in the center of the mullion 20. The reinforcing rods are optional for use with long span windows where additional strength is required.

Opposite the integral glass retaining members 42 and 44 of the mullion 20 are a pair of slots 50 and 52 on either side of the center of the mullion profile. Furthermost from the integral glass retaining means 42 and 44 of the mullion 20 is a flange 54 extending on opposite sides of a center web 56 of the mullion 20. A pair of longitudinally extending V-notches or grooves 58 are formed in the flange on opposite sides of the center web 56.

In a similar manner the peripheral framing members 22 or 24 include a pair of slots 60 on opposite sides of a center web 62 of the member. A flange 64 is integrally formed at the termination of the web 62 opposite the integral glass retaining member 38. Also formed in the flange 64 are a pair of V-shaped notches or grooves 66 facing toward the integral glass retaining means 38.

On the back side of the peripheral framing member 22 is a third slot 68 and a third longitudinally extending groove 70 formed in a longitudinally extending protrusion 72. The slots 50 and grooves 58 in the mullion 20 as well as the slots 60 and grooves 66 and the slot 68 and groove 70 in the peripheral framing member 22 are all of identical size and spacing to form engagement means for separate extruded glass retaining means 74.

The glass retaining means 74 include co-extruded glass seals 40 and complementary engagement means comprising a longitudinally extending L-shaped protrusion 76 and a peaked protrusion 78 spaced from the protrusion 76. The outer surface 80 of the glass retainer 74 extends over and is spaced from the peaked protrusion 78.

To engage the glass retainer in the mullion 20 or the peripheral frame member 22, the protrusion 76 is slipped into a slot 50, 60 or 68 as appropriate and the peaked protrusion 78 snapped into the groove 58, 66 or 70 as appropriate. As shown the glass retainers are mitered at 82 to complete the assembly.

To assemble the window framing system as shown in FIG. 1 the mullion 20 and vertical peripheral frame members 22 are screwed to the horizontal frame member 26 and a second horizontal frame member (not shown) attached across the top of the window assembly. A window pane can then be pushed up against the glass seals 40 of the integral glass retainers 38 and 42. The separate glass stops 74 are inserted into the slots 52 and 60 and are snapped into the grooves 58 and 66 to complete the assembly. With small windows and tight assemblies or exceptionally rigid glass retainers, a straight cut at 82, either horizontally or vertically, can be substituted for the miter cut.

Figure 14:
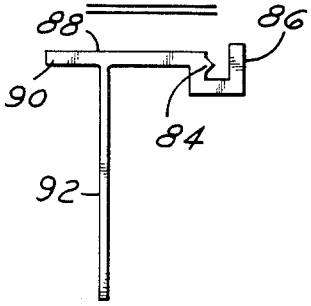
FIG. 14 is a profile view of a nailing strip.

As an accessory item a nailing strip, also shown in FIG. 14, includes a peaked protrusion 84 and covering flange 86 extending longitudinally from the web 88 of the nailing strip. A portion of the longitudinal edge of the web 88 is configured 90 to slip into the slot 68 or optionally 60 on either side of the peripheral framing member 24 for attachment to the building structure. The nailing strip includes a fin 92 suitable for attaching to the building structure. The fin 92 also covers any gap between the building structure and the peripheral frame 24 or 22.

Figure 2:
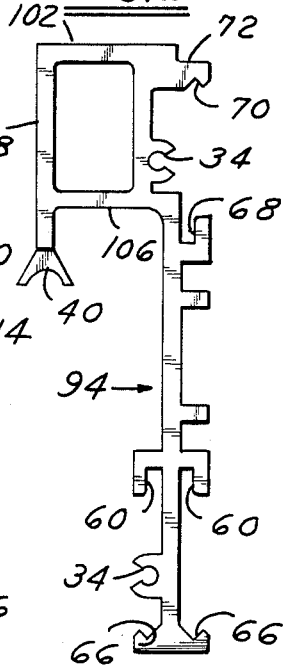
FIG. 2 is a profile view of a peripheral frame member.
Figure 3:
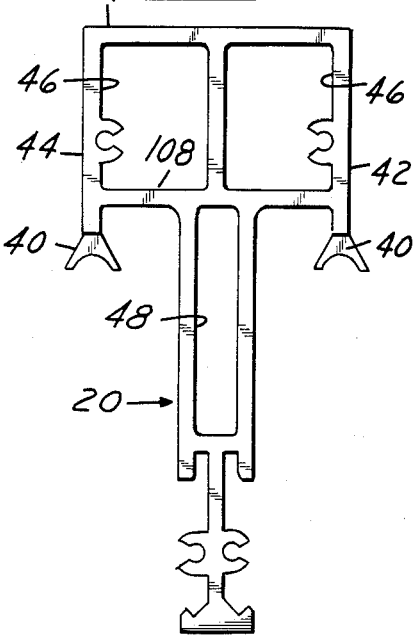
FIG. 3 is a profile view of a mullion.
Figure 6:
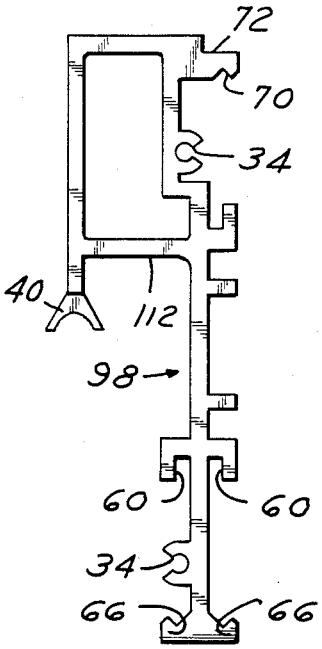
FIG. 6 is a profile view of an extended depth peripheral frame member.
Figure 4:
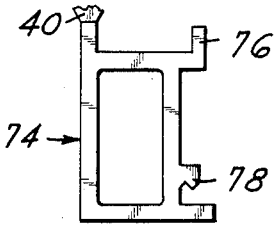
FIG. 4 is a profile view of a shallow depth glass retainer.
Figure 5:
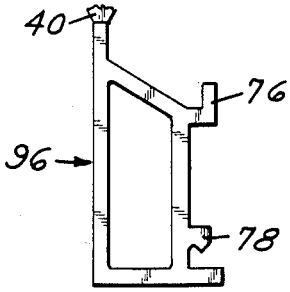
FIG. 5 is a profile view of an extended depth glass retainer.

FIGS. 2 through 7 illustrate the basic extrusion configurations in profile view. FIG. 2 illustrates the basic shallow depth peripheral framing member generally denoted as 94 and corresponding to the peripheral framing members 22 and 24 in FIG. 1. FIG. 4 illustrates the corresponding shallow depth glass retainer generally denoted as 74 and corresponding to glass retainers 74 in FIG. 1. FIGS. 5 and 6 illustrate the extended depth glass retaining member generally denoted by 96 and the extended depth peripheral framing member generally denoted by 98. As is explained below either of the glass retaining members 74 or 96 may be attached to either of the peripheral framing members 94 and 98. Thus, the spacing and configuration of the slots 60 and 68 of peripheral framing member 94 and peripheral framing member 98 and the grooves 66 and 70 of both members are identical and designated with the same numbers. Likewise, the complementary attachment means comprising the longitudinal protrusions 76 and peaked protrusions 78 of both the shallow glass retaining member 74 and the extended depth retaining member 96 are identical in size and spacing.

The basic profiles illustrated in FIGS. 2, 4, 5 and 6 are the minimum necessary to provide a complete framing system in addition to the nailing strip in FIG. 14 and, as shown below, can be configured to create mullions as well as peripheral frames for the windows. The four profiles in the various combinations disclosed below can accommodate three different glazing thicknesses. The thicknesses are preferably selected to be the glazing thicknesses most popular in the northern and southern portions of the United States for single glazing and double glazing. These thicknesses are one inch and $\frac{5}{8}$ inch glazing depth for double glazing and $\frac{1}{4}$ inch for single glazing.

Two specific mullion profiles can also be included in the system to eliminate some of the assembly time otherwise required for mullions. The shallow depth mullion is generally denoted by 20 in FIG. 3 and the extended depth mullion is generally denoted by 100 in FIG. 7. The spacing and configuration of the slots 50 and 52 on either side of the mullion and the grooves 58 on either side of the single mullion web 56 are spaced to accommodate the glass retainers of FIGS. 4 and 5.

Figure 7:
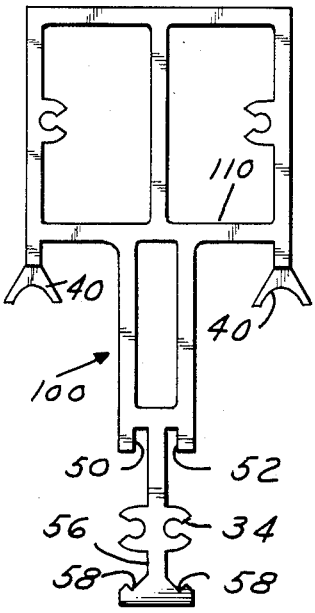
FIG. 7 is a profile view of an extended depth mullion.

Returning to FIGS. 2 and 3, the distance between the glass seal 40 and the outer surface 102 of the peripheral framing member 94 is the same as the distance between the glass seal 40 and the outer surface 104 of the mullion. However, the distance from the outer surface 102 to the outside of the web 106 of the integral glass retaining portion 38 of the peripheral framing member 94 is equal to the distance from the outer surface 104 to the inside surface of the cross web 108 of the mullion 20. This configuration provides a face to face contact location where the mullion is notched into the peripheral framing member as shown in FIG. 1. Thus, the surface of cross web 108 abuts the surface of cross web 106 at the notched juncture between the parts. A large surface is thereby provided for adhesive means to be used in attaching the mullion to the peripheral framing member if so desired. In a similar manner the cross web 110 of the mullion 100 in FIG. 7 is positioned to contact the outside surface of the cross web 112 of the peripheral framing member 98 in FIG. 6.

Figure 8:
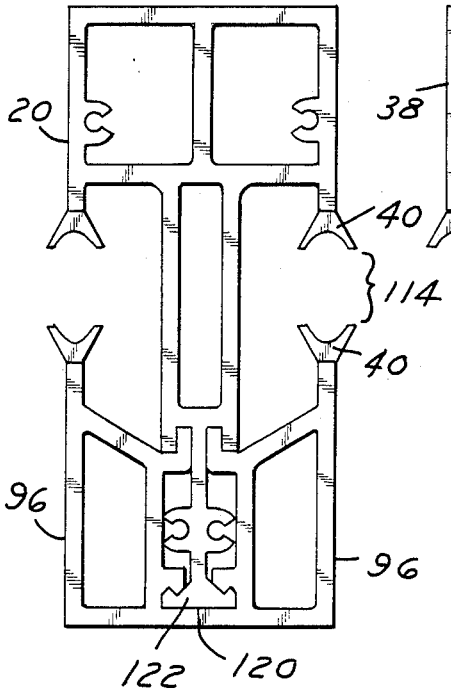
FIG. 8 is a profile view of a shallow depth mullion combined with two extended depth glass retainers.
Figure 9:
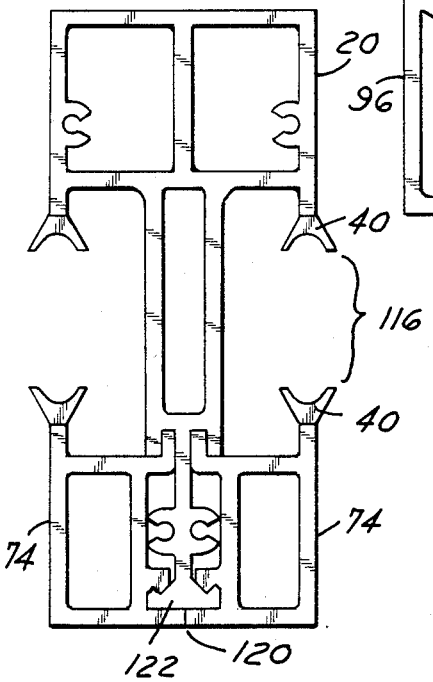
FIG. 9 is a profile view of a shallow depth mullion combined with two shallow depth glass retainers.
Figure 10:
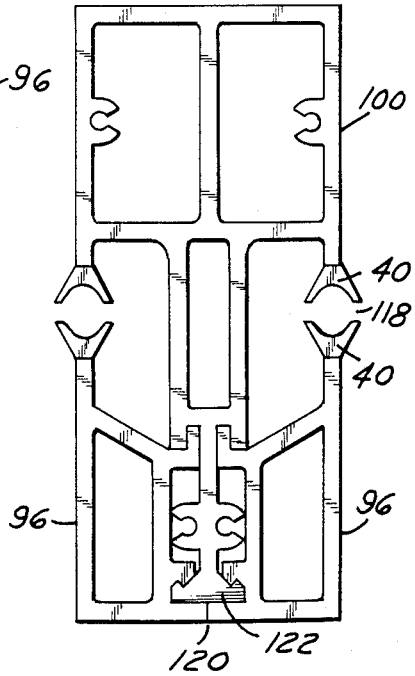
FIG. 10 is a profile view of an extended depth mullion with two extended depth glass retainers.

In FIGS. 8, 9 and 10 various combinations of each of the mullions 20 and 100 with the glass retainers 74 and 96 illustrate the three different glazing depths that can be accommodated. FIG. 8 illustrates the shallow depth mullion 20 in combination with a pair of extended depth glass retainers 96 to form an intermediate sized gap 114 between the glass seals 40. In FIG. 9 the mullion 20 is combined with a pair of shallow depth glass retainers 74 to form a maximum sized gap 116 between the pair of glass seals 40. The intermediate gap 114 in FIG. 8 and the maximum gap in FIG. 9 are typically used for double glazing, the larger one being more often selected for use in northern climates and the intermediate gap being more often selectd for use in southern climates. FIG. 10 illustrates the use of the extended depth mullion 100 with the extended depth glass retainers 96 to form a minimum gap 118 between the glass seals 40. The minimum gap, typically about $\frac{1}{4}$ inch, is for single pane glazing in any installation. As illustrated in FIGS. 8, 9 and 10 the combination of a mullion with two glass retainers creates a rectangular profile into which the glazing is inserted on either side. Only a fine line at 120 where the two glass retainers come together over the end 122 of the mullion discloses to the viewer that the mullion is not one single rectangular structure in profile.

Figure 11:
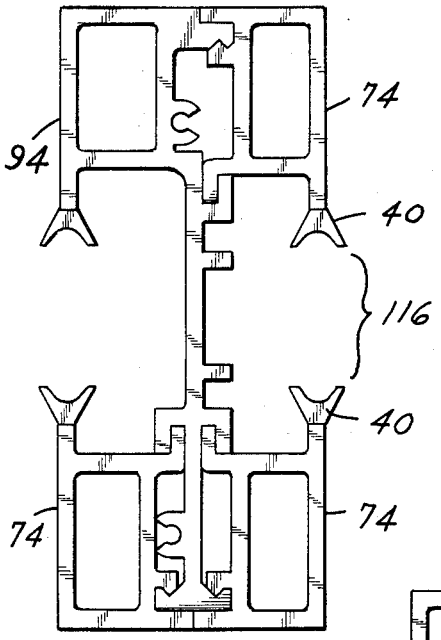
FIG. 11 is a profile of a shallow depth peripheral frame member combined with three shallow depth glass retainers to form a complete mullion and retainer assembly.
Figure 13:
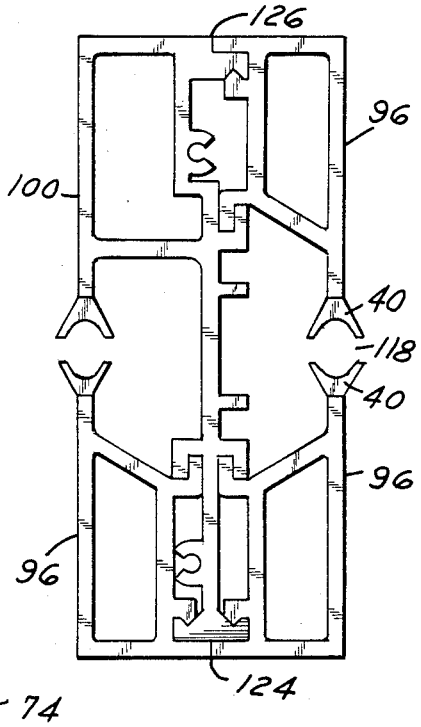
FIG. 13 is a profile view of an extended depth peripheral frame member combined with three extended depth glass retainers to form a completed extended depth mullion and retainer assembly.
Figure 12:
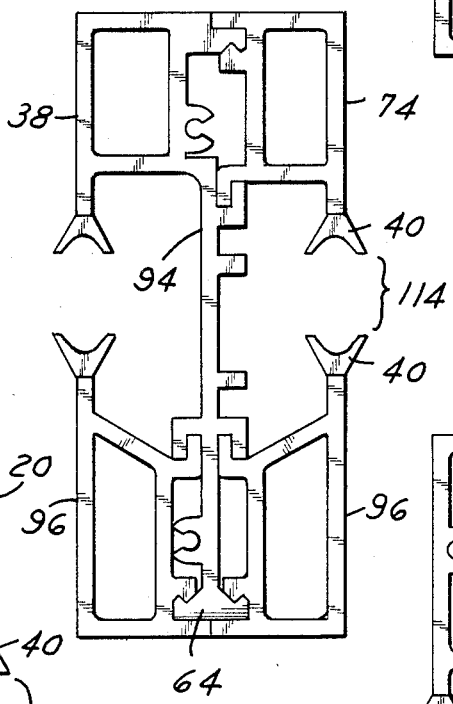
FIG. 12 is a profile view of a shallow depth peripheral frame member combined with a shallow depth glass retainer and two extended depth glass retainers to form a complete mullion and retainer assembly.

FIGS. 11, 12 and 13 illustrate in profile view how mullions with the three different glazing thicknesses can be created by combining three of the glass retaining members with single peripheral frame members thereby eliminating the tooling cost for separate mullion extrusion dies. In FIG. 11 a shallow depth peripheral framing member 94 is combined with three shallow depth glass retaining members 74 to create a maximum depth gap 116 between the glass seals 40.

To create an intermediate depth gap 114 between the glass seals 40, a single shallow depth glass retaining member 74 as shown in FIG. 12 is attached opposite the shallow depth integral glass retaining portion 38 of the shallow depth peripheral framing member 94. A pair of extended depth glass retaining members 96 are attached to the opposite edge about the flange 64 of the peripheral framing member 94.

In FIG. 13 the extended depth peripheral framing member 100 is combined with three extended depth glass retaining members 96 to form a minimum gap 118 between the glass seals 40 for single glazing. In FIGS. 11, 12 and 13 the outward appearance of the mullion is that of a smooth rectangle with only fine lines at 124 and 126 visible on the outside of the mullion.

Figure 15:
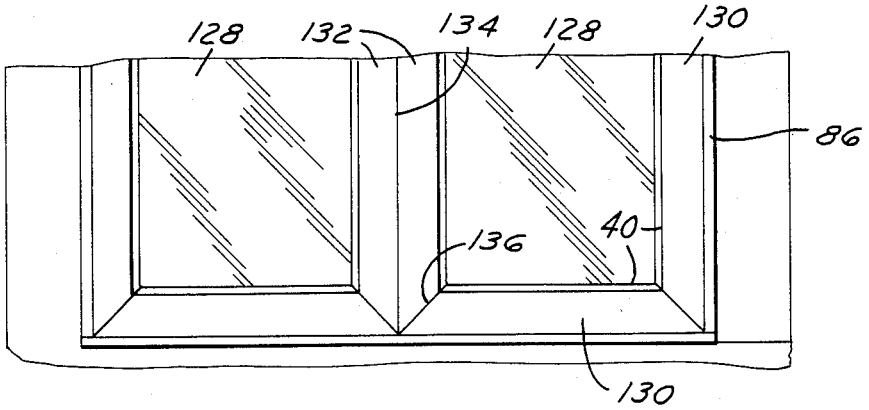
FIG. 15 is a partial front view of two window panes installed with the window framing system.

FIG. 15 illustrates the appearance of a double pane window constructed with the above framing system. The glazing 128 is set within the mullion and framing with only a small edge of the glass seal 40 extending beyond the peripheral framing or glass retaining member 130 and mullion glass retaining members 132. Only the small outside cover portion 86 of the nailing fin 88 shows about the peripheral frame. A fine line 134 between the glass retaining means 132 of the mullion in addition to the fine lines 136 at the beveled corner joints of the glass retaining means are the only visible extended joints in the completed window assembly.

Figure 16:
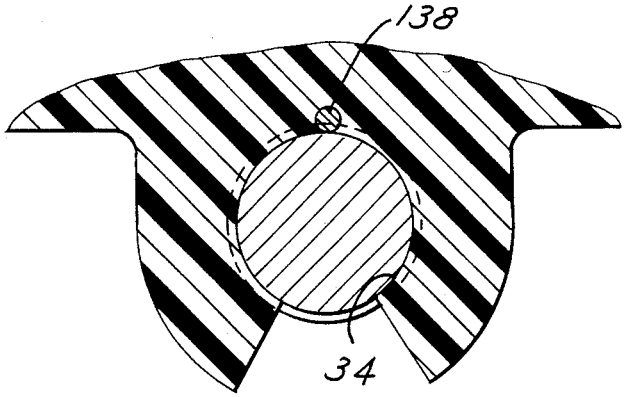
FIG. 16 is a broken away cross section of a modified screw spline.
Figure 17:
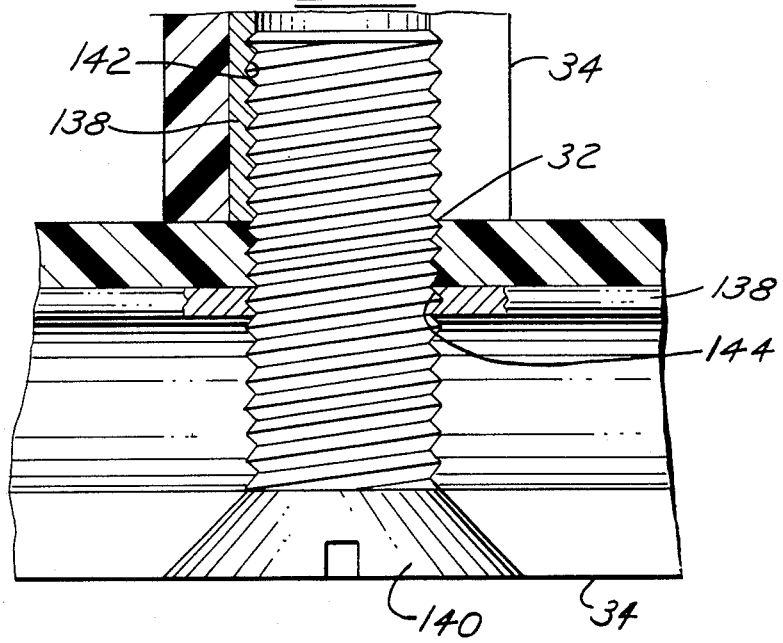
FIG. 17 is ia partial broken away view of the screw spline attachment of the modified screw spline of FIG. 16.

FIGS. 16 and 17 illustrate the inclusion of a fine copper wire 138 co-extruded with plastic mullions and peripheral framing members. The small copper wire is located closely adjacent the screw spline 34 such that the threads 142 of fastening screws 140 will contact and dig into the copper wire at the junctures of framing members and mullions. The upper threaded portion 144 of the screw 140 contacts the wire 138 in the adjoining member to complete an electrical circuit between two joined portions of the framing system. Thus, a completed window frame will have an electrically conductive loop around the glazing on each side of the glazing. A suitable size for the copper wire is 22 gauge. Preferably copper or brass screws are utilized for the framing system. The wire loops can serve as low voltage sources of electric power or conduits for sensing means and attachments to the window glazing or window framing.

We claim:

1. An extruded plastic window framing system comprising at least two differing asymmetric peripheral framing members and at least two separate differing glass retainers attachable to any of said peripheral framing members, each of said peripheral framing members comprising in profile a single integral glass retainer and a web extending asymmetrically therefrom, a pair of integral symmetric in profile engagement means on said web spaced from said integral glass retainer and located on either side of said web, and glass engagement means on said integral glass retainer, a third integral engagement means located in profile on the opposite side of each of said asymmetric framing members from said integral glass retainer and spaced from said pair of integral engagement means, each of said pair of integral engagement means being symmetric to the other about said web, said third integral engagement means being symmetric to said integral engagement means on the same side of the web about a transverse plane equidistant therebetween, each of said separate glass retainers comprising in profile integral engagement means, said engagement means of each of said separate glass retainers being complementary to any of said pair or third engagement means on either side of each of said peripheral framing members and glass engagement means on each of said separate glass retainers, and, wherein in profile said two differing peripheral framing members differ therebetween in the location of said glass engagement means relative to the web, and said two differing separate glass retainers differ therebetween in the location of said glass engagement means relative to the complementary engagement means of each of said separate glass retainers.

2. The window framing system of claim 1 wherein the assembly of three separate glass retainers with the three integral engagement means of one peripheral framing member results in a substantially rectangular outside periphery in profile of the assembly.

3. The window framing system of claim 1 wherein any one glazing thickness from three possible glazing thicknesses can be selected by selecting one of said two differing peripheral framing members and one of said two differing separate glass retainers and assembling said member and retainer together into opposed relationship for retaining the glazing therebetween.

4. The window framing system of claim 1 including at least two differing mullion members, each of said mullion members comprising in profile a pair of symmetric integral glass retainers, glass engagement means on said glass retainers, a central web extending from said pair of symmetric integral glass retainers, a pair of symmetric integral engagement means on said central web and spaced from said pair of symmetric integral glass retainers, said pair of symmetric integral engagement means on said central web each engageable with the complementary engagement means of any of said separate glass retainers.

5. The window framing system of claim 4 wherein the assembly of two separate glass retainers with the pair of symmetric integral glass retainers on said central web results in a substantially rectangular outside periphery in profile of the assembly.

6. The window framing system of claim 4 wherein any one glazing thickness from three possible glazing thicknesses can be selected by selecting one of said two differing mullion members and one of said two differing separate glass retainers and assembling said member and retainer together into opposed relationship for retaining the glazing therebetween.

7. An extruded plastic window framing system comprising at least two differing peripheral framing members and at least two separate differing glass retainers, each of said peripheral framing members comprising in profile an integral glass retainer and a web extending therefrom, a pair of integral symmetric in profile engagement means on said web spaced from said integral glass retainer and located on either side of said web, and glass engagement means on said integral glass retainer, a third integral engagement means located in profile on the opposite side of said framing member from said integral glass retainer and spaced from said pair of integral engagement means, each of said pair of integral engagement means being symmetric to the other about said web, said third integral engagement means being symmetric to said integral engagement means on the same side of the web about a transverse plane equidistant therebetween, each of said separate glass retainers comprising in profile integral engagement means, said engagement means being complementary to any of the three engagement means on either side of said peripheral framing members and glass engagement means on each of said separate glass retainers, and, wherein in profile said two differing peripheral framing members differ therebetween in the location of said glass engagement means relative to the web, and said two differing separate glass retainers differ therebetween in the location of said glass engagement means relative to the complementary engagement means of each of said separate glass retainers, at least two differing mullion members, each of said mullion members comprising in profile a pair of symmetric integral glass retainers, glass engagement means on said glass retainers, a central web extending from said pair of symmetric integral glass retainers, a pair of symmetric integral engagement means on said central web and spaced from said pair of symmetric integral glass retainers, said pair of symmetric integral engagement means on said central web each engageable with the complementary engagement means of any of said separate glass retainers, wherein said peripheral framing members and mullion members include integral screw splines longitudinally extended therewith, and electrically conductive means embedded in the peripheral framing members and mullion members and extending longitudinally adjacent said screw splines.

8. The window framing system of claim 7 wherein said electrically conductive means are sufficiently close to said screw splines to provide electrical interconnection between members when joined by metal screws driven through holes in said screw splines or threaded into said screw splines.

9. An extruded plastic window frame comprising a plurality of extruded plastic framing members surrounding an opening for a window pane, at least one of said framing members including one or more integral screw splines in said member and an electrically conductive means embedded in the member and extending longitudinally adjacent said screw spline.

10. The extruded plastic window frame of claim 9 wherein said electrically conductive means are sufficiently close to said screw splines to provide electrical interconnection between members when joined by metal screws driven through holes in said screw splines or threaded into said screw splines.

11. The extruded plastic window frame of claim 9 wherein at least one metal screw passes through a hole in the screw spline of at least one member and is threaded into the screw spline of an adjacent member to join said members together and said electrically conductive means is engaged by the screw in said hole in one member and in said spline in the adjacent member such that the electrically conductive means in the adjacent joined members is electrically connected.

* * * * *

UNITED STATES PATENT AND TRADEMARK OFFICE

CERTIFICATE OF CORRECTION

PATENT NO. : 4,621,478

DATED : November 11, 1986

INVENTOR(S) : H.V. Phillips & Michael A. Walton

It is certified that error appears in the above-identified patent and that said Letters Patent are hereby corrected as shown below:

Column 2, line 32: Correct "recesse" to --recesses--.

Column 4, line 36: Insert --24 at notch-- before "26".

Signed and Sealed this

Third Day of February, 1987

*Attest:*

DONALD J. QUIGG

*Attesting Officer*

*Commissioner of Patents and Trademarks*